US006868163B1

(12) United States Patent
Goldstein

(10) Patent No.: US 6,868,163 B1
(45) Date of Patent: Mar. 15, 2005

(54) HEARING AIDS BASED ON MODELS OF COCHLEAR COMPRESSION

(75) Inventor: Julius L. Goldstein, University City, MO (US)

(73) Assignees: BECS Technology, Inc., St. Louis, MO (US); Hearing Emulations, LLC, St. Louis, MO (US)

( * ) Notice: Subject to any disclaimer, the term of this patent is extended or adjusted under 35 U.S.C. 154(b) by 0 days.

(21) Appl. No.: 09/158,411

(22) Filed: Sep. 22, 1998

(51) Int. Cl.[7] ..... H04R 25/00
(52) U.S. Cl. ..... 381/321; 381/312; 381/320
(58) Field of Search ..... 381/60, 106, 312, 381/320, 321, 318, 93, 107, 108; 333/14; 455/72

(56) References Cited

U.S. PATENT DOCUMENTS

| | | | |
|---|---|---|---|
| 3,920,931 | A | 11/1975 | Yanick, Jr. |
| 3,989,904 | A | 11/1976 | Rohrer et al. |
| 4,536,844 | A | 8/1985 | Lyon |
| 4,887,299 | A | 12/1989 | Cummins et al. |
| 5,357,251 | A | 10/1994 | Morley, Jr. et al. |
| 5,402,493 | A | 3/1995 | Goldstein |
| 5,832,097 | A | 11/1998 | Armstrong et al. |
| 5,838,807 | A | 11/1998 | Andersson et al. |
| 5,903,655 | A | 5/1999 | Salmi et al. |
| 5,923,767 | A | 7/1999 | Frindle et al. |

FOREIGN PATENT DOCUMENTS

| | | |
|---|---|---|
| FR | 2610162 | 7/1988 |
| GB | 2310983 | 9/1997 |
| WO | WO9818294 | 5/1999 |

OTHER PUBLICATIONS

Abbas, P.J. and Sachs, M.B., Two–tone suppression in auditory–nerve fibers: Extension of stimulus response relationship. J. Acoust. Soc. Am. 59, 112–122 (1976).
Goldstein, Julius L., Modeling rapid waveform compression on the basilar membrane as multiple–band–pass–nonlinearity filtering, Hearing Research, 49 (1990) pp. 39–60.

(List continued on next page.)

*Primary Examiner*—Huyen Le
(74) *Attorney, Agent, or Firm*—Thompson Coburn, LLP

(57) ABSTRACT

Methods and devices for audio amplification suitable for hearing aid, hearing aid fitting, and diagnostic purposes include audio amplification having at least one variable gain channel configured to provide relatively higher gain at low levels, rapid gain compression at intermediate levels converging to linear gain at high signal levels, and slow feedback control of the compressive gain. Several such audio channels may be provided in a hearing aid or diagnostic device, and instantaneous gain compression is preferred. An analog implementation provides nonlinear elements in a feedback path to simulate a multiple feedback band-pass non-linearity cochlear filterbank hearing model (MFBPNL), while a digital implementation uses logarithmic representations of signals to minimize functional components in a multiple band-pass non-linearity cochlear filterbank hearing model (MBPNL). When used as a hearing aid, annoying amplification of weak sounds during brief interruptions of sustained intense sounds is prevented. Moreover, the quality of processing of intense sounds is improved, while still protecting the ear from uncomfortable, sudden intense sounds that occur too rapidly for effective correction by conventional automatic gain control.

23 Claims, 10 Drawing Sheets

OTHER PUBLICATIONS

Goldstein, Julius L., Changing Roles in the Cochlear Bandpass Filtering by the ORgan of Corti and Additive Amplification on the BaSilian Membrane, ASA Meeting, New Orleans, LA, Paper 4aPP3, Nov. 3, 1992, pp. 1–14.

Ghitza, Oded, Adequacy of auditory models to predict human internal representation of speech sounds, pp. 2160–2171.

Brundin, Lou et el., Sound Induced Movements and Frequency Tuning in Outer Hair Cells Isolated From the Guinea Pig Cochlea, PREPRINTS, Symposium: Biophysics of Hair Cell Sensory Systems, Duifhuis, et al., Editors, pp. 121–127.

J. Santos–Sacchi, On the Frequency Limit and Phase of Outer Hair Cell Motility: Effects of the Membrane Filter, The Journal of Neuroscience, May 1992, 12(5): pp. 1906–1916.

Jont B. Allen and Stephen T. Neely, Micromechanical Models of The Cochlea, Physics Today, Jul., 1992, pp. 40–47.

Dillon, Tutorial Compression? Yes, But for Low or High Frequencies, for Low or High Intensities, and with What Response Times?, *Ear & Hearing*, 17:287–307 (1996).

Dillon, Compression, Noise, and Audibility: A Reply to Villchur, *Ear & Hearing*, 18(2): 172–173 (1997).

Engebretson, Benefits of Digital Hearing Aids, *IEEE Engineering in Medicine and Biology*, pp. 238–248 (Apr./May 1994).

Goldstein, Exploring new principles of cochlear operation: bandpass filtering by the organ of Corti and additive amplification by the basilar membrane, *Proceedings of the International Symposium on Biophysics of Hair Cell Sensory Systems*, pp. 315–322 (Jun. 28 –Jul. 3, 1993).

Goldstein, Cochlear Signal Processing for Compression and Gain Control Extends Dynamic Range and Preserves Temporal Modulation, *NIDCD/VA Hearing Aid Research and Development Conference*, Sep. 22–24, 1997.

Goldstein, Relations among compression, suppression, and combination tones in mechanical responses of the basilar membrane: data and MBPNL model, *Hearing Research* 89:52–68 (1995).

Killion et al., The 3 Types of Sensorineural Hearing Loss: Loudness and Intelligibility Considerations, *The Hearing Journal* 46(11):31–34 (1993).

Lin et al., Implementation of the MBPNL Nonlinear Cochlear I/O Model in the C Programming Language, and Applications for Modeling Impaired Auditory Function, *ModelingSensorineural Hearing Loss*, Chapter 4, pp. 67–78 (1997).

Plomp, Noise, Amplification, and Compression: Considerations of Three Main Issues in Hearing Aid Design, *Ear & Hearing* 15(1):2–12 (1994).

Villchur, Comments on "Compression? Yes, But for Low or High Frequencies, for Low or High Intensities, and with What Response Times?", *Ear & Hearing*, 18(2):169–171 (1997).

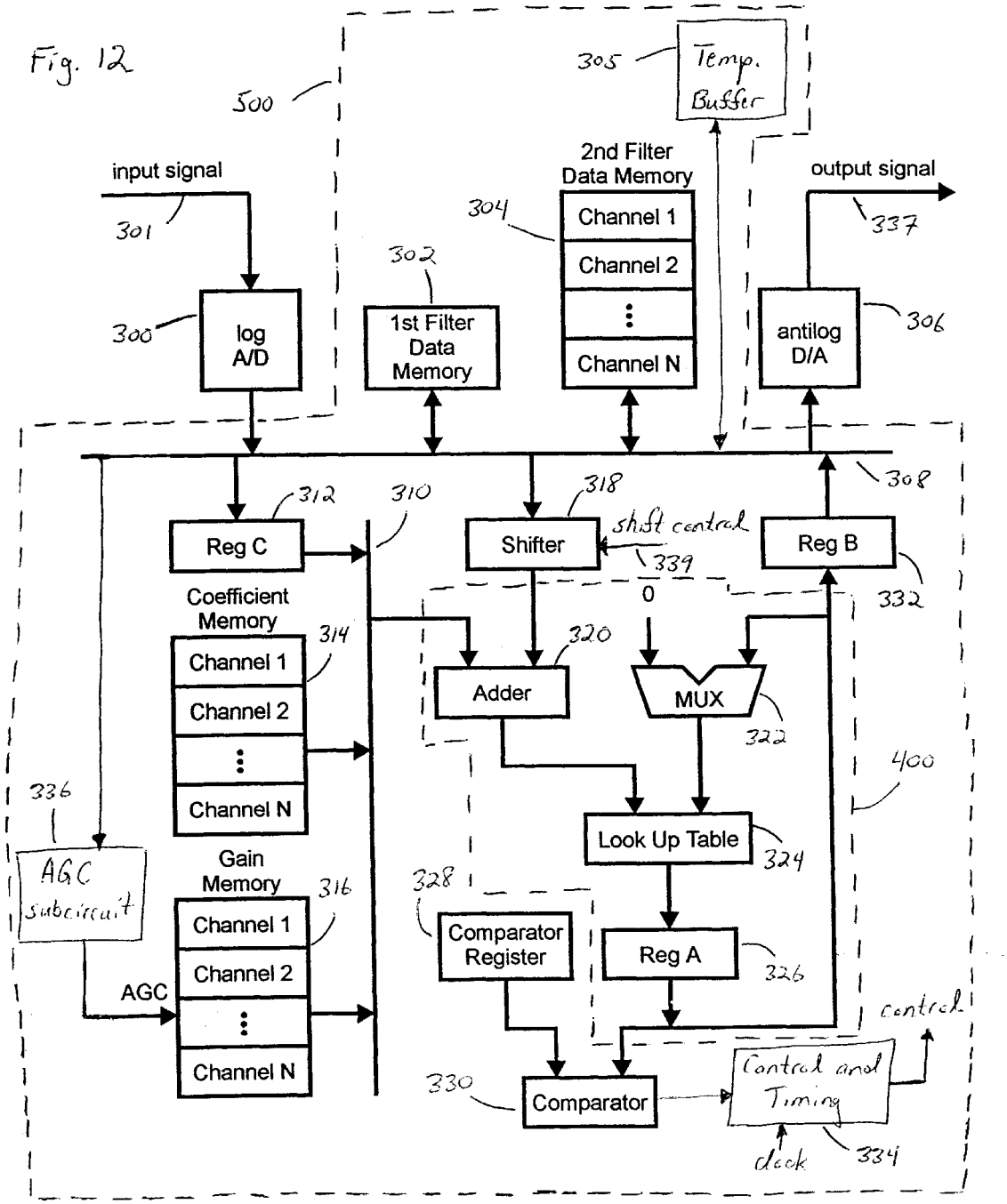
Fig. 12
500
305
Temp. Buffer
input signal
301
2nd Filter Data Memory
304
Channel 1
Channel 2
Channel N
output signal
337
302
1st Filter Data Memory
300
log A/D
antilog D/A
306
308
312
310
318
Reg C
Shifter
shift control
339
Reg B
332
Coefficient Memory
314
Channel 1
Channel 2
Channel N
0
320
Adder
MUX
322
400
336
AGC subcircuit
Look Up Table
324
Gain Memory
316
328
Channel 1
Channel 2
Channel N
Comparator Register
Reg A
326
AGC
control
330
Comparator
Control and Timing
clock
334

SIGNAL MODULATION $$\mu \sim [E_{max} - E_{min}] / [E_{max} + E_{min}]$$

$$\mu(X) := \frac{\max(|X_n|)}{\left[\frac{\pi}{2 \cdot N} \cdot \left(\sum_n |X_n|\right)\right]} - 1$$

HEARING AIDS BASED ON MODELS OF COCHLEAR COMPRESSION

BACKGROUND OF THE INVENTION

1. Field of the Invention

This invention relates to the field of electronic filters and amplifiers for electroacoustic systems such as hearing aids, and more particularly to methods and devices for clinical testing and for correction of hearing impairment.

2. Description of the Related Art

Hearing impairment is most commonly expressed as a loss of sensitivity to weak sounds, while intense sounds can be as loud and uncomfortable as in normal hearing. State-of-the-art hearing aids treat this phenomenon of "loudness recruitment" with sound amplification that automatically decreases with sound amplitude. This compresses the range of normally experienced sound amplitudes to the smaller range required by the impaired ear. The best engineering approach to compression has, however, been uncertain. Rapid compression amplifiers protect the ear from uncomfortable changes in loudness, but nonlinearly distort the sound waveform. Slowly adapting compression avoids the distortion, but allows some loudness discomfort.

Recent advances in hearing aid development have been largely driven by availability of inexpensive miniaturized electronic analog and digital signal processors. The classical audiological problem of loudness recruitment, which older hearing aids solved with a manual volume control, is now solved with sound compression systems that automatically provide greater amplification for weak than for intense sounds. In a recent comprehensive and authoritative review, Harvey Dillon, in *Ear and Hearing* 17:287–307 "Compression? Yes, but for low or high frequencies, for low or high intensities, and for what response times?" [comments by Vilchur, and reply by Dillon, 1997, in *Ear and Hearing* 18:169–173] found that 1) "for speech in quiet at a comfortable level, no compression system yet tested offers better intelligibility than individually selected linear amplification" (i.e., manual volume control), and 2) "In broadband noise, only one system, containing wideband compression followed by fast acting high-frequency compression, has so far been shown to provide significant intelligibility advantages."

The need for improved hearing aids and audiological fitting procedures is widely attested to by research efforts worldwide. It has been said that over 28 million Americans have hearing impairments severe enough to cause a communications handicap. While hearing aids are the best treatment for most of these people, only about 5 million actually own hearing aids, and fewer than 2 million are sold annually. In addition, less than 60% of hearing aid owners are actually satisfied with their hearing aids.

Loudness recruitment, or loss of dynamic range, is the basic audiological problem confronting hearing aid design. Modern hearing aids automatically compress the range of sound levels into a much smaller range, as needed. Broad agreement exists that the most general and potentially successful design is a multichannel compressive hearing aid that addresses the compression needs of each band of audible frequencies. Sharp disagreement exists, however, over whether wide dynamic range compression should be instantaneous or slowly adapting.

It has been suggested that rapid compression is fundamentally flawed and that multichannel hearing aids should use a slowly acting graded volume control with approximately ¼ second attack and delay times with gradual gain reduction. This suggestion is based on the psychophysical fact that rapid compression reduces perceptually useful temporal modulation in auditory signals. It is known that loss of slow modulation (i.e., 4–16 Hz) in speech signals degrades its intelligibility. However, one study showed that the effect of rapid compression is severe only for compression ratios greater than two. Also rapid compression may be required when the residual dynamic range in the hearing impairment is smaller than the instantaneous fluctuations in normal discourse. Recent comprehensive data on speech statistics indicate that a ~30 dB range maximum is required to include 90% of all short-term RMS samples (125 ms window), while ~40 dB is required to capture the instantaneous speech peaks for bands of speech. Other research indicates that the latter range is relevant, so that rapid compression may be best for smaller residual dynamic ranges.

It will thus be appreciated that there is a need for more rational guidance to the design of hearing aids, and more particularly guidance that is derived from models of nonlinear cochlear signal processing. Correspondingly, there is a need for devices and methods that allow systematic audiological testing of the benefits of the new hearing aid design and fitting of individual hearing aids.

BRIEF DESCRIPTION OF THE INVENTION

There is thus provided, in accordance with the invention, in a hearing amplification device, an improvement comprising the hearing amplification device including an audio amplifier having at least one variable gain channel configured to provide relatively higher gain at low sound levels, rapid gain compression at intermediate levels converging to linear gain at high levels, and slow AGC control of the compressive gain. Preferably, the audio amplifier comprises a plurality of variable gain channels responsive to different frequency ranges, and the rapid gain compression is instantaneous gain compression. The audio amplifier may be realized as either an analog or a digital implementation, using nonlinear feedback loops. In either implementation, the gain should approach unity for instantaneous high signal levels, and automatic gain control should be provided that slowly reduces low-level sensitivity in the presence of sustained high level signals.

There is further provided, in accordance with another aspect of the invention, a method of amplifying an audio signal in a hearing amplification device, comprising the steps of providing a variable gain channel configured to provide relatively lower gain at high sound levels and relatively higher gain at low levels; providing rapid gain compression at intermediate levels converging to linear gain at high signal levels; and controlling the relatively higher gain at low levels via slow AGC control.

There is also provided a method of providing amplification to correct impaired hearing comprising the steps of determining an amount of weak signal compressive gain $G_c$ and compression power p required to correct the hearing impairment; and providing audio amplification in accordance with a gain characteristic of a member of the group consisting of MFBPNL and MBPNL gain characteristic having weak signal compressive gain $G_c$ and compression power p. Preferably, the method is repeated for a plurality of frequency channels.

It is thus an object of the invention to provide methods and apparatuses for hearing aid fitting, hearing aid amplification, and various diagnostic purposes that are derived rationally from models of nonlinear cochlear signal processing.

It is a further object of the invention to provide methods and devices for systematic audiological testing.

It is yet another object of the invention to provide methods and devices for amplification of audio signals for hearing impairment that provide increased intelligibility.

It is still another object of the invention to provide methods and apparatuses for correcting and fitting hearing impairments that avoid annoying amplification of weak sounds during brief interruptions of sustained intense sounds, and that provide reduced harmonic and intermodulation distortion while preserving temporal modulation.

The realization of these and other objects of the invention will become apparent to one skilled in the art upon study of the several views of the drawings and the accompanying description of the invention.

BRIEF DESCRIPTION OF THE DRAWINGS

FIG. 12 is a simplified block diagram of an amplifier in accordance with the invention using a single DSP circuit and which is suitable for diagnostic and fitting purposes;

DETAILED DESCRIPTION OF THE INVENTION

As used herein, a "hearing amplification device" refers to a hearing aid, a hearing aid fitting device (i.e., a testing device used to select appropriate characteristics of a hearing aid for a hearing impaired individual), or a hearing diagnostic device.

Figure 1:
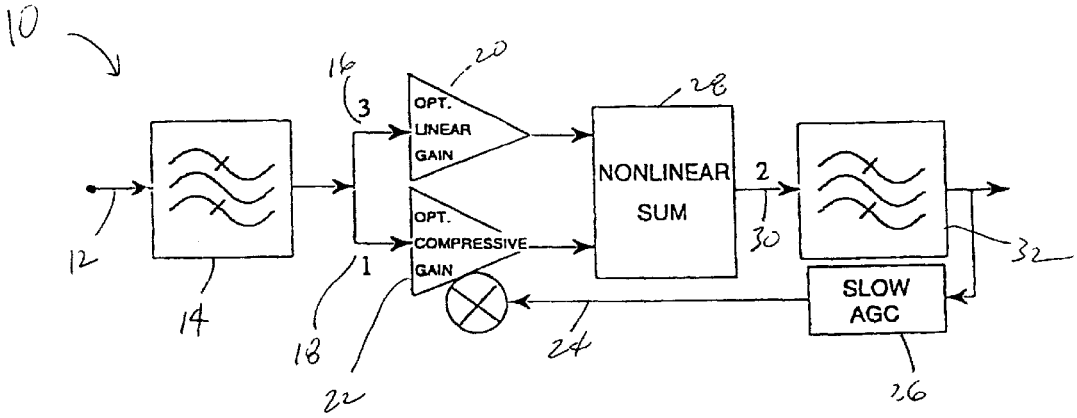
FIG. 1 is a simplified block diagram of a cochlear-based paradigm for hearing aid amplification in accordance with the invention.

FIG. 1 shows a simplified block diagram of a preferred embodiment of a cochlear-based paradigm for hearing aid amplification in accordance with the invention. One channel 10 is illustrated in FIG. 1, although it is contemplated that a hearing aid or diagnostic device preferably will be provided with a plurality of channels, each acting on different audio frequency ranges. Usually, the ranges will comprise contiguous bands covering the useful audio range, but this may depend upon the gain correction required. It should be understood that, although a hearing aid or diagnostic device could be implemented by a literal implementation of the blocks shown in FIG. 1, such an implementation would not necessarily be optimal from a circuit design standpoint. Preferred analog and digital implementations are discussed in conjunction with other figures presented herewith, but FIG. 1 conveniently serves to explain the general principles behind the invention.

In the amplification channel 10 shown in FIG. 1, sound pressure is converted by a conventional transducer (such as a microphone, which is not shown) to a suitable signal that is applied to the channel at 12. This signal is passed through a band pass filter 14, while other channels can process different frequency bands independently of one another. The signal from the output of band pass filter 14 is then split into two separate paths 16 and 18. Path 16 provides a simple linear gain 20. In fact, this gain is usually equal to 1, but may be different (and if so, it would usually be greater than 1) for hearing aids or diagnostic applications, depending upon clinical data, or it may be adjustable, if channel 10 is part of a diagnostic device. (In rare instances, the gain may be less than 1 if excess sensitivity to loud noises is a problem.) If gain 20 is equal to or less than 1, those skilled in the art will recognize that active components would not be required to physically implement the "gain" element 20.

Path 18 provides for compensation of loudness recruitment by providing a gain 22 that rapidly reduces with increasing sound level. A second compression system, comprising slow AGC 26 and path 24, controls gain compression based upon the channel's output. The slow AGC 26 reduces maximum sensitivity of gain 22 for sustained high-level signals. The output of gain 20 and gain 22 are summed nonlinearly at 28 in a manner to be described below. The resulting signal 30 is passed through another bandpass filter 32 having the same frequency characteristics as filter 14. If there are multiple channels 10, the outputs of each are summed together linearly. Ultimately, the output of channel 10 or the sums of multiple channels 10 are converted to a sound by a suitable conventional transducer (such as a speaker or earphone, neither of which is shown, depending upon the intended application).

Figure 2:
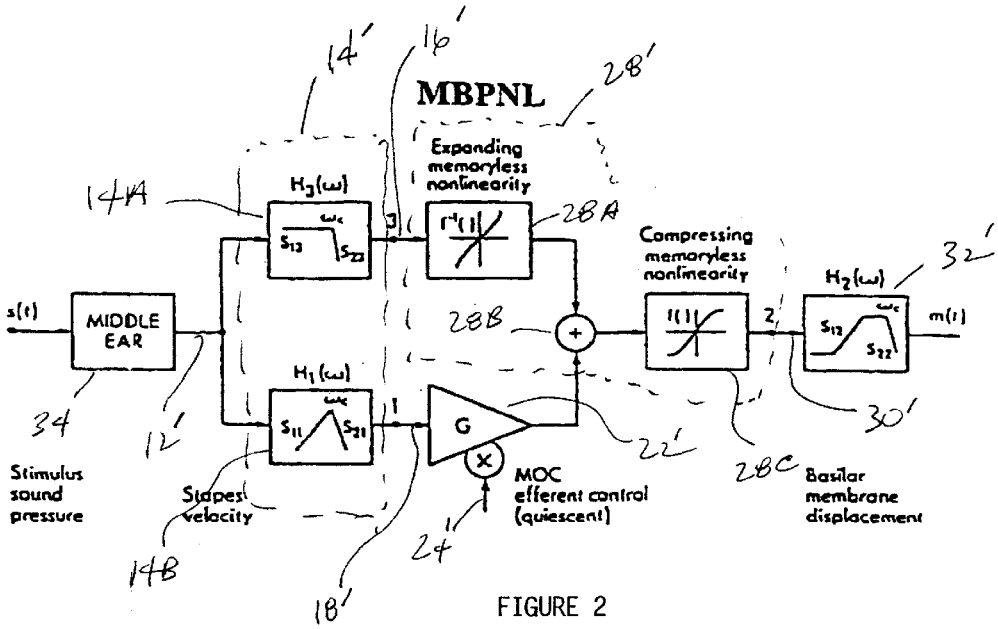
FIG. 2 is block diagram of a MBPNL (multiple band-pass non-linearity) cochlear filterbank hearing model.
Figure 3:
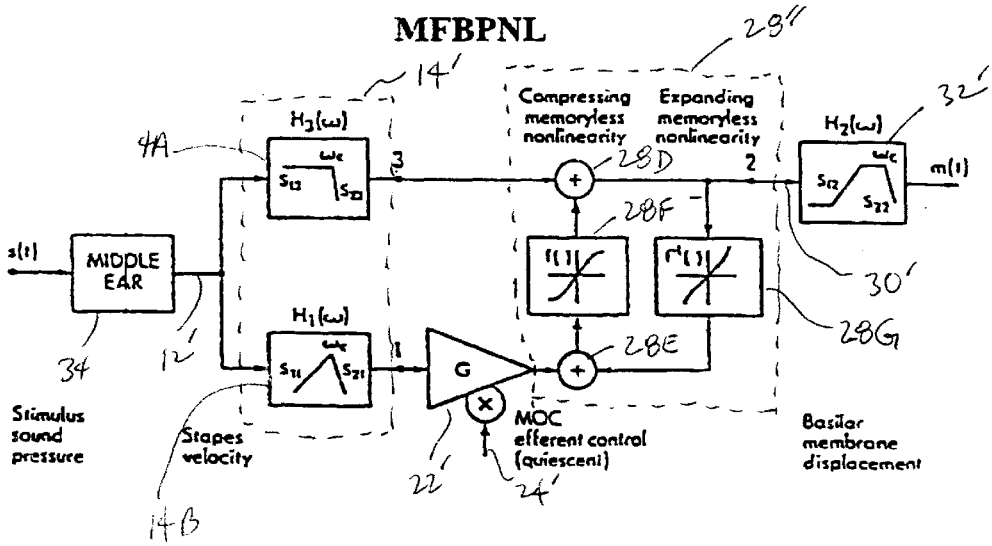
FIG. 3 is a model of a multiple feedback band-pass non-linearity cochlear (MFBPNL) filterbank hearing model.

It is an important feature of the invention that the nonlinear sum 28 have a form consistent with the human hearing models of FIGS. 2 and 3. FIG. 2 represents a multiple band-pass non-linearity cochlear filterbank model (MBPNL). Studies of cochlear physiology reveal that this physiology provides wide range dynamic compression that is both instantaneous and slowly adapting. Cochlear frequency tuning curves published in the literature show both a "tip" and a "tail." The "tip" response is rapidly compressive, with its sensitivity under efferent control. "Tip" response determines cochlear sensitivity. Normal efferent function is unknown, but has characteristics of slow automatic gain control. Outer hair cell damage impairs the "tip" response. In the model of FIG. 2, a stimulus sound pressure s(t) is applied to the middle ear 34. The filtering that takes place in the MBPNL model before a basilar membrane displacement results is now described.

Filter 14 of FIG. 1 corresponds to two separate filters 14A and 14B shown in block 14' in the model of FIG. 2. (The primed reference numerals refer to points of the cochlear model that correspond to elements of the hearing aid or diagnostic device 10 of FIG. 1. This equivalence is shown to emphasize that the hearing amplification device 10 design is guided by the cochlear models.) The first of these is filter 14A, which is a low pass filter having characteristic response $H_3(\omega)$. The second is filter 14B, which is a band pass filter having a characteristic response $H_1(\omega)$. The outputs of these filters appear in this model at lines 16' and 18', respectively. No explicit gain is shown in line 16', because that gain is modeled as unity (i.e., 0 dB). Gain 22 in FIG. 1 is shown as a gain block 22' in FIG. 2 having gain G. Gain block 22' is under MOC (medial olivocochlear) efferent control 24'.

Nonlinearity 28' is modeled as a block 28A having an expanding memoryless nonlinearity $f^{-1}(u, u_0, p)$, having arguments as defined below. Block 28A operates only on the portion of the signal on line 16' that has not had gain control applied to it, but the output of block 28A is linearly summed with the output of gain block 22' at adder 28B. The output of this adder is input to the compressing memoryless nonlinearity $f(u, u_0, p)$ at block 28C. As is suggested from the nomenclature, $f(u, u_0, p)$ is the inverse nonlinearity to $f^{-1}(u, u_0, p)$. Finally, an output m(t) is produced through the filter 32' with transfer function $H_2(\omega)$, which represents the basilar membrane displacement that results from stimulus sound pressure s(t).

FIG. 3 is a model of a multiple feedback band-pass non-linearity cochlear (MFBPNL) filterbank model. The difference between this model (which is the preferred model for an analog implementation of this invention) and the model of FIG. 2 lies in nonlinearity block 28", which now includes negative feedback comprising nonlinearities 28F and 28G (which provide the memoryless nonlinearities $f(u, u_0, p)$ and $f^{-1}(u, u_0, p)$, respectively) and adders 28D and 28E. (The input to nonlinearity 28G is inverted in phase as indicated in FIG. 3 to provide negative feedback.) It should be noted that the MFBPNL model is the subject of U.S. Pat. No. 5,402,493, issued Mar. 28, 1995 to one of the present inventors (J. L. Goldstein), the specification of which is hereby incorporated by reference in its entirety. In that patent, this cochlear model is applied for the purpose of electronically simulating cochlear response. The present invention extends the teaching in U.S. Pat. No. 5,402,493 to use the models described therein to implement diagnostic device fitting devices, and hearing aids based upon those models; i.e., the various types of hearing amplification devices.

The functions $f(u, u_0, p)$ and $f^{-1}(u, u_0, p)$ are defined as follows:

$$f(u, u_0, p) \triangleq u_0 sgn(u)\left[\left(1+\left(\frac{u}{u_0}\right)^4\right)^p - 1\right]^{\frac{1}{4}} \text{ and}$$

$$f^{-1}(u, u_0, p) \triangleq f(u, u_0, 1/p),$$

where:

p=compression power (typically between ½ and ⅓);

1/p="compression ratio,"

u=input level, $u_0$=the linear/nonlinear threshold breakpoint, and $G_0$=gain of a healthy cochlea (typically 100–300).

A family of merging gain functions, in accordance with the invention, is obtained using a different threshold value $u_c$ for each weak signal gain $G_c$, where:

$$u_c = u_o\left(\frac{G_0}{G_c}\right)^{\frac{p}{1-p}}.$$

This method is efficiently used in the analog implementation, while a second method that is more efficient for a DSP (digital signal processor) implementation is also provided. The DSP system maintains a constant threshold, uses pre- and post-amplification $G_1$ and $G_2$ that depend upon $G_c$, where $$G_1 = \left(\frac{G_c}{G_0}\right)^{\frac{p}{1-p}}, \text{ and } G_2 = \frac{1}{G_1}.$$

Figure 4:
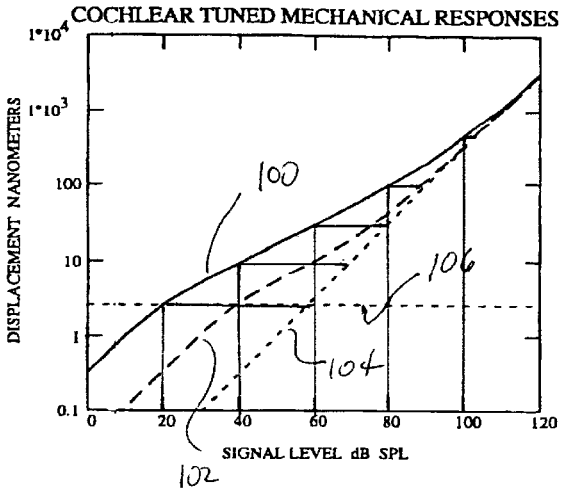
FIG. 4 is a drawing of a family of tuned cochlear mechanical responses.

A family of tuned cochlear mechanical responses is shown in FIG. 4. These tuned cochlear responses represent the most sensitive response to a pure tone at a given frequency. Line 100 represents the response of a normal cochlea. Line 102 represents the response of a moderately impaired cochlea, and represents a common recruitment situation requiring correction. Line 104 represents the response of severely impaired cochlea. The horizontal axis represents the sound pressure level in dB, while the vertical axis is a logarithmic scale representing cochlear displacement in nanometers. Observations by one of the inventors (J. L. Goldstein) confirms that a compressive breakpoint occurs in recruitment cases at a nearly fixed level that is evident from lines 100, 102, and 104. This level is shown by horizontal line 106.

Figure 5:
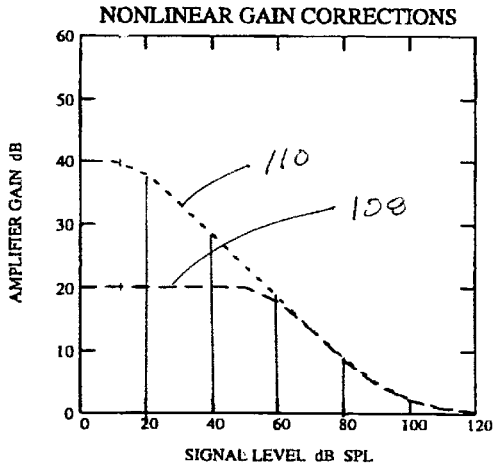
FIG. 5 is a drawing showing the required nonlinear gain corrections for both the moderately impaired cochlea and the severely impaired cochlea of FIG. 4.

FIG. 5 shows the required nonlinear gain corrections for both the moderately impaired cochlea and the severely impaired cochlea of FIG. 4. The gain correction required for the moderately impaired cochlea is represented by curve 108, while the gain correction required for the severely impaired cochlea is represented by curve 110. These curves are derived from FIG. 4 by noting the horizontal distance in dB between the responses of the healthy and the impaired cochleas at the signal levels in dB shown. For example, at 20 dB SPL in FIG. 4, curve 100 representing the response of a healthy cochlea shows a displacement of about 2.5 nanometers. A gain of slightly less than 40 dB is required to provide the same displacement for the severely impaired cochlea, while a gain of only 20 dB is required for the moderately impaired cochlea. At 40 dB SPL, a gain of slightly less than 30 dB is required for the severely impaired cochlea, while a gain of 20 dB still suffices for the moderately impaired cochlea. At about 60 dB SPL, the gain required for both the moderately and the severely impaired cochlea is about 20 dB. At greater SPLs, the required gain is essentially the same for both the moderately and severely impaired cochlea, and this gain diminishes as SPL increases, approaching 0 dB for levels above approximately 100 dB SPL.

Figure 6:
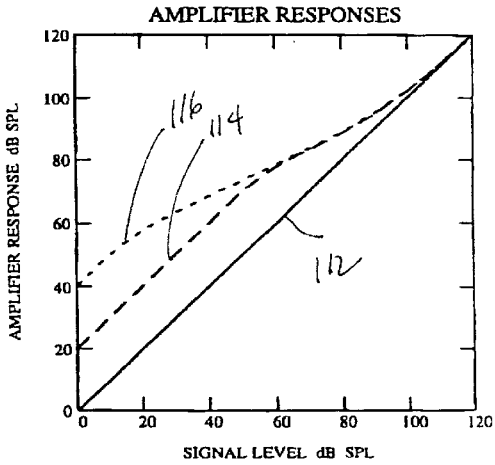
FIG. 6 is a graph showing representative members of a preferred family of amplifier responses.

One significant observation, for purposes of this invention, is that the amplification amounts needed for correction of different levels of impairment severity surprisingly merge (i.e., the amplifications become essentially the same) at a moderate level of amplification within the compressive range. In doing so, important information related to the intelligibility of sounds is advantageously not lost at high SPLs, because linear response at these levels is maintained without either compressive distortion or amplification to painful levels. Representative members of a preferred family of amplifier responses in accordance with this observation are shown in FIG. 6. Curve 112 in FIG. 6, which is shown for reference purposes only, represents the amplification gain that would be required for a healthy cochlear response (in the particular frequency band to which the curve pertains), which is unity across the entire range of signal levels, indicating that no hearing aid correction would be required. Curve 114 represents the gain required for a moderately impaired cochlear channel, while curve 116 represents the gain required for a severely impaired cochlear channel. Thus, the merging characteristics of the amplifier responses is a preferred characteristic of a multichannel hearing aid. Each of the curves 116 and 114 have a section at low signal levels that provide a constant gain, a middle region providing an instantaneously variable compressive gain, and a section at high signal levels that provides unity gain.

The nonlinear cochlear responses represented in FIG. 4 are generated by a very rapid biological compression system, which has been modeled as instantaneous compression (FIG. 2). This mechanism prevents overamplification of rapidly growing sounds, but generates nonlinear distortions. The MOC (medial olivocochlear) efferent control in FIGS. 2 and 3 represents a second biological compression system. It behaves as a slow automatic gain control (AGC), under brainstem control, that can decrease the gain G. Its effect is represented in FIG. 4 by the curve described above for a moderate hearing impairment, amounting to an irreversible reduction in G. MOC control provides reversible reductions in G that can be used to advantage for improving the quality of cochlear response (improved linearity) to sustained strong sounds, while reducing sensitivity to weak sounds present in brief interruptions of the strong sounds. Both compression systems are included in hearing aid designs in accordance with this invention.

A preferred analog implementation of a hearing aid in accordance with the invention realizes the transducer functions f and $f^{-1}$ with inversely related nonlinear circuits, incorporating an expansive transducer defined as $$E(u) = \left(\frac{u_0}{G_0}\right) sgn(u) \left|\frac{u}{u_0}\right|^{\frac{1}{p}}.$$

Figure 7:
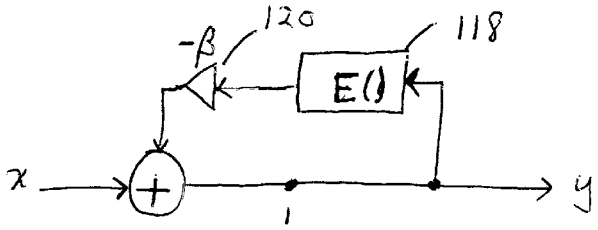
FIGS. 7 and 8 are simplified schematic representations of implementations of memoryless nonlinearities that are included in amplifiers in accordance with the invention.
Figure 8:
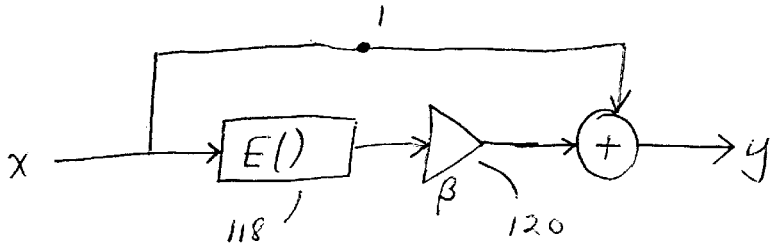
Figure 9:
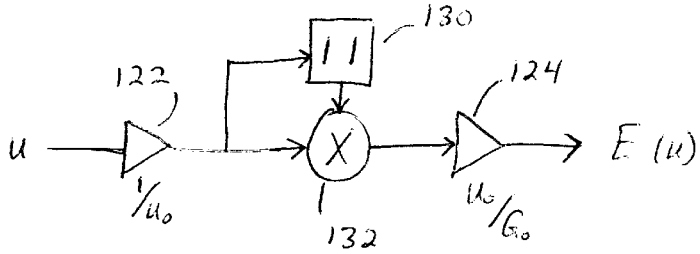
FIGS. 9 and 10 are simplified schematic representations of implementations of expansive gain functions in accordance with the invention.
Figure 10:
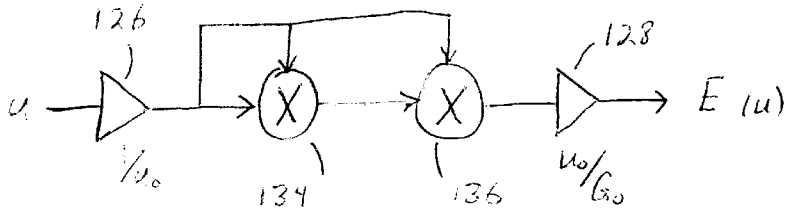

The circuit of FIG. 7 provides the function f( ), while the circuit of FIG. 8 provides the function $f^{-1}$( ). The responses of the circuits shown in FIG. 7 and FIG. 8, for $\beta=G_0$, are approximated by f(u, $u_0$, p) and $$f\left(u, u_0, \frac{1}{p}\right),$$

respectively. An analog amplifier 120 is shown in both FIG. 7 and FIG. 8. A single amplifier may be used to provide the functions shown in both figures, as will be seen shortly. Analog multipliers for the expansive gain function E( ) shown as block 118 in FIG. 7 and FIG. 8 may be realized as shown in FIG. 9 and FIG. 10. FIG. 9 shows a realization for p=½, while FIG. 10 shows a realization for p=⅓. Gain elements 122, 124, 126, and 128 are shown, but depending upon the values of $u_0$ and $G_0$, one or more of these may be voltage dividers rather than amplifiers. Block 130 represents an absolute value operation, whereas blocks 132, 134, and 136 are multipliers.

Figure 11:
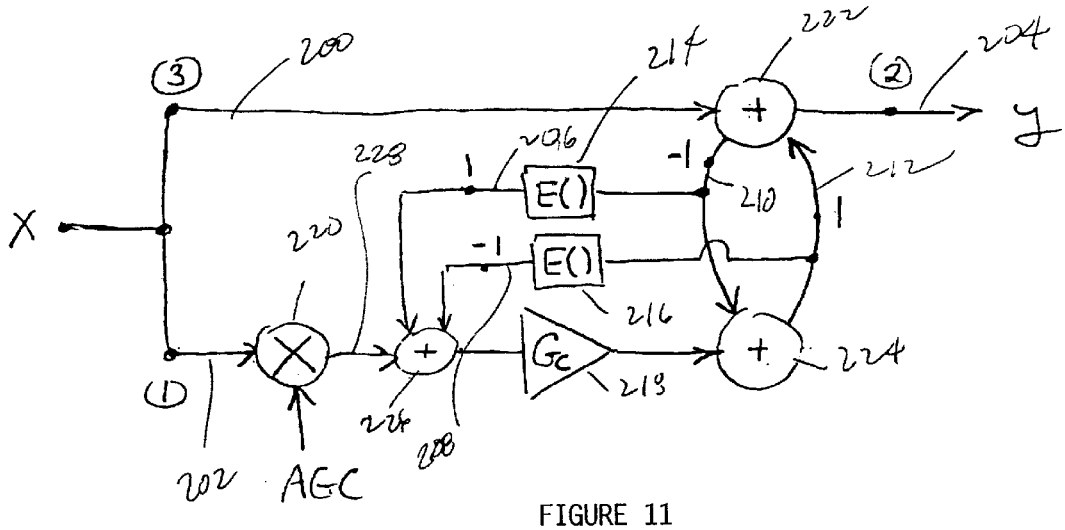
FIG. 11 is a schematic representation of an amplifier circuit in accordance with the invention that provides compensation in accordance with the MFBPNL model.

In accordance with another aspect of the invention, it is possible to use the above realizations in a circuit according to FIG. 1 to provide compensation in accordance with the model of FIG. 3 in a manner such that a family of compressive gain correction such as that represented in part in FIGS. 5 and 6 may be realized in a circuit by varying the gain of a single linear amplifier. The topology of this preferred circuit is shown in FIG. 11. This circuit provides compensation in accordance with the MFBPNL model, thereby avoiding excessive internal signal levels at the expander output that arise in the open-loop MBPNL model. In addition, the "push-pull" feedback of the MFBPNL model minimizes even-order distortions caused by mismatches in analog implementations of the transducers f( ) and $f^{-1}$( ).

In this model, a signal representing sound pressure transformed by a suitable transducer (such as a microphone, not shown) arrives at x (after having been passed through a band pass filter) and is split into two paths 200 and 202. The output of the amplifier, which may represent one channel of a multichannel hearing aid or diagnostic testing device, appears as signal y at 204, and is suitably transformed (after additional band pass filtering, not shown in the figure) into sound pressure by a transducer (such as a speaker or a microphone, also not shown, in accordance with the intended application). By convention, a dot placed in a path with a gain number beside it indicates that the path, at that point, has the gain indicated by the gain number. Thus, path 206 has unity gain as the signal exits block 214, but path 208 has a gain of −1 as the signal exits block 216. Path 212 is also a unity gain path as it leaves linear summing block 224, while path 210 has a gain of −1 as it leaves linear summing block 222. (The paths with gains of −1 may be implemented with inverting amplifiers at the dot locations, for example.) Path 200 is equivalent to path 16 and gain block 20 of FIG. 1, and it is sufficient in most cases for this gain block to have unity gain. Path 202 is equivalent to path 18 in FIG. 1. Multiplier 220 provides a function equivalent to the slow AGC control provided by compressive gain block 22 in FIG. 1. Unity gain is provided when the AGC path is quiescent, and a reduced gain as AGC is provided. Blocks 214 and 216 are the E( ) blocks shown in FIG. 9 or FIG. 10, depending upon whether p is selected to be ½ or ⅓, respectively. The family of merging gain curves is achieved by varying the gain $G_c$ of amplifier 218.

Placement of amplification $G_c$ within the feedback loop in FIG. 11 efficiently realizes the family of merging compressive gain functions for different values of $G_c$. The AGC must remain outside the loop. An alternative implementation, with $G_c$ outside the loop under AGC control could also be constructed, but pre- and post-amplifiers $G_{1\ and\ G2}$ would then be required at the input and output, respectively, for merging gain functions. This alternate implementation could be advantageous when using specialized integrated circuits with fixed parameters, and for optimizing the design to prevent instability.

Note that for high sound levels, the gain of the circuit of FIG. 11 is ½ because of the feedback, but that for low level sounds, the gain is $(1+G_c)/2$. Although band pass filters are not shown in FIG. 11, they are provided at the input and output of the circuit, and multiple copies of the circuit may be provided in parallel for processing sound in independent frequency ranges. The channels would be connected in parallel with one another and their outputs linearly summed to provide processing over an entire audio frequency range of interest, such as that range that is important to the understanding of speech sounds. Note that nonlinear summing block 28 of FIG. 1 corresponds to the circuit comprising blocks 214, 216, 218, 222, 224, and 226 in FIG. 11, and that adders 222 and 224 correspond to adders 28D and 28E, respectively, in FIG. 3. It is contemplated that gain $G_c$ may be fixed in a hearing aid device in accordance with the impairment measured in a particular individual's ear, but that gain $G_c$ would be variable in a device, such as a desktop device, to be used for clinical and diagnostic purposes.

Conventional slow AGC using multiplier 220 is derived from the output of the channel (not shown in FIG. 11, but shown in FIG. 1). The slow AGC (26 in FIG. 1) may be implemented using conventional circuitry. However, when employed in the circuit of FIG. 11, such AGC inventively provides the advantage of a slowly varying control of the maximum sensitivity of the rapidly compressing response of the channel. This prevents annoying amplification of weak sounds during brief interruptions of sustained intense sounds. In addition, the quality of the processing of the intense sounds is improved by the more linear-like hearing aid response, viz. reduced harmonic and intermodulation distortion and preservation of temporal modulation.

It is significant in this invention that the AGC is not applied to the entire response of the amplifier, as in most previous designs, nor is the entire level control provided by a single, slow-response mechanism, as in others. Instead, fast-acting, non-linear elements that essentially instantaneously compress the high-level input signal are combined with relatively slow-acting gain control in a manner that reduces the maximum gain sensitivity to weak signals in the presence of sustained high levels. The presence of rapid compression also has the advantage of protecting the ear from uncomfortable, sudden intense sounds that occur too rapidly for effective conventional AGC control. Furthermore, rapid switching between compressive and linear responses for high signal levels is obtained in accordance with the invention, which cannot be done by linearly summing a rapidly compressing response and a linear response—i.e., the nonlinearity of the interaction between the two gain paths is important.

A preferred digital implementation of an amplifier in accordance with the invention is shown in FIG. 12. This implementation provides a multiply-accumulate 400 for FIR filters, and a variable gain MBPNL transfer function. (An MFBPNL function could be provided, but this function is more computationally intensive and subject to numerical instabilities. The analog implementation of MFBPNL has no such numerical instabilities, of course, and the inventive implementation of the analog circuitry provides no stability problems, if good engineering practices are used and the circuit is engineered consistent with the disclosure herein.)

The implementation uses limited hardware resources that can easily be implemented in VLSI circuitry, requiring one adder 320, one shifter 318, one look-up table (LUT) 324, and one comparator 330. This is done in a manner that is easily adjusted by AGC feedback such as with a conventional AGC circuit 336 in conjunction with gain memory 316. In this implementation, the function f( ) is approximated as:

$$f(u,u_0,p)=u,\ |u|\leq u_0;$$

$$sgn(u)\cdot k|u|^p,\ |u|>u_0;$$

where k is chosen such that the upper and lower terms are equal at $u=u_0$; i.e., $k=u_0^{1-9}$. In the description below, f( ) is used as a function of only u, with $u_0$ and p being held constant.

Initially, input signals for the channel amplifier arrive at 301 and are converted by a logarithmic A/D converter 300. The resulting digital signals are placed on a bus 308. Control and timing for this conversion and for other aspects of this channel amplifier are derived from a clock and controller 334, the design of which, in view of this description, would be within the range of ordinary skill in the art for a digital circuit designer, and is therefore not considered part of this invention. The logarithmic A/D converter 300, as well as the antilog D/A converter 306 can be shared across channels. In this case, separate busses 308 would be required for each channel, and the interconnection of the busses to converters 300 and 306 is described below in conjunction with FIG. 14. All other components shown in FIG. 12 would then be duplicated for each channel. Alternately, the digital arithmetic could be executed N times faster for N channels and the memories 304, 314, 316 expanded to accommodate the memory necessary for all of the channels. In either case, the output of all of the channels must be added together, in a manner to be described below, to produce output signal 337.

The converted input signal, now appearing on bus 308, must be filtered, implementing block 14 in FIG. 1. This is accomplished by first, storing the sample in first filter data memory 302 in FIG. 12. Then, a loop is executed that implements an FIR filter on all of the data in 1st filter data memory 302, including the most recent sample and older samples. This loop is a multiply-accumulate loop that is accomplished using subsystem 400. Data is recalled from memory 302 through shifter 318, which is set at this stage to simply pass the data through unchanged. The other input into adder 320 is provided on bus 310 from coefficient memory 314. The addition that takes place in adder 320 is effectively a multiplication, because it will recalled that the data was converted by a logarithmic A/D converter 300.

The output of adder 320 is next applied to a look-up table (LUT) 324. The first iteration, multiplexer 322 selects the "0" input to initialize the filter calculation. Effectively, the two inputs to LUT 324 form a memory address, and the contents of the selected memory location are transferred to register A 326. The contents of the LUT represent the sum of the two inputs represented in logarithmic form. For the second and all subsequent iterations, multiplexer 322 selects the output of register A. Each subsequent iteration uses a different sample that has already been stored in first filter data memory 302, and a different coefficient from 314, in a manner that is known to those familiar with FIR filters. During this phase of operation, i.e., the FIR filter phase operation, register C 312 and gain memory 316 are unused. (It is worth pointing out that the preferred embodiment described herein implements an FIR filter, but with minor modifications to either the coefficients or the control sequence, an IIR filter could be implemented in place of the FIR filter.) At the end of the filter operation sequence, the result is accumulated in Register A 326.

After the result of the FIR filter is accumulated, function f( ) is applied to implement the MBPNL transfer function. (The term "transfer function" may be understood by some as encompassing only linear functions, but it is explicitly intended as used herein to encompass nonlinear functions as well.) The MBPNL transfer function can be described by $G_2f(G_1G_cu+f^{-1}(G_1u))$, where $G_c$ is set by AGC feedback and represents the variation in gain that corresponds to the adjustable gain in the analog system, $G_1$ is a preamplification gain, and $G_2$ is a postamplification gain, and u is the result value (i.e., the result of the FIR (or IIR, as the case may be) from the filter operation described above. $G_c$ is a value stored in gain memory 316 that is derived from AGC subcircuit 336 in a conventional way, taking into account values of onset and recovery selected in accordance with clinical requirements.

Figure 13:
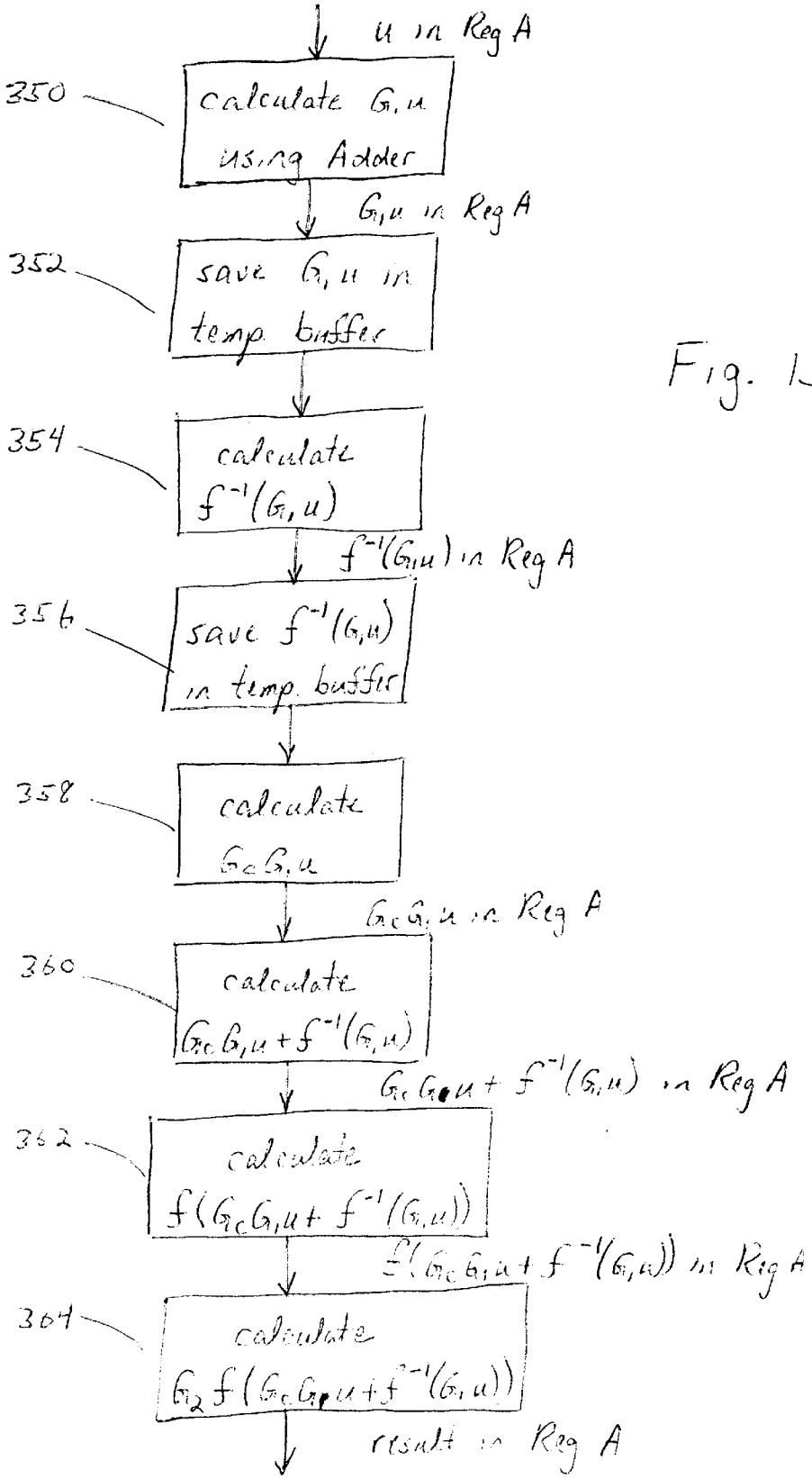
FIG. 13 is a graph showing the spectral responses to the steady state vowel sound EH for amplifiers in accordance with the invention.

Referring briefly to FIG. 13, the next sequence of operations to be accomplished by the apparatus represented by FIG. 12, i.e., the calculation of $G_2f(G_1G_cu+f^{-1}(G_1u))$, is described. Referring to both FIGS. 12 and 13, the flow chart of FIG. 13 is entered at block 350 with the result u already calculated as above and available in register A 326. To calculate the required function, at block 350, $G_1u$ is calculated using adder 320 and this result is stored in register A 326. Next, at block 352, the result is stored in a temporary memory or buffer 305. The function $f^{-1}(G_1u)$ is then calculated at block 354 in the flow chart of FIG. 13. That result is also accumulated in register A 326, and then, at block 358, stored in temporary memory 305. Next, at block 356, the value $G_cG_1u$ is calculated and stored in register A. The next step, shown in block 360, is to calculate $G_cG_1u+f^{-1}(G_1u)$ and store the result in register A. Finally, at blocks 362 and 364, $f(G_cG_1u+f^{-1}(G_1u))$ is calculated, multiplied by $G_2$, and the result stored in register A.

The steps shown in FIG. 13 are accomplished by the device represented in FIG. 12 by the following sequence. Recall that the value u starts out in register A 326 as a result of the FIR filtering described above. First, the value u in register A 326 is copied into register B 332. Next, the value in register B 332 is copied to bus 308, sent through shifter 318 (which is configured as a pass-through at this point), and into adder 320, to form one of the inputs to the multiplication function (recall that the values being added are in logarithmic form). The second input $G_1$ for the multiplication to be performed by adder 320 is obtained from gain memory 316 via bus 310. The result of the operation is passed through LUT 324 (with multiplexer 322 providing a zero input) and stored in register A 326. The result, which represents $G_1u$, is sent to register B 332 and from there into temporary memory 305 via bus 308. Note, however, that the result is also retained in register A 326.

The function $f^{-1}(G_1u)$ is calculated as follows. The value in register A 326 is compared to the value in compare register 328 (which is a fixed value set at fitting time based on clinical data for an individual's impairment and corresponds to $u_0$, which sets the threshold linear/nonlinear breakpoint. If the value in register A 326 is less than or equal to the value in register 328 (in reality, it does not matter which selection is made if the values are equal, but it is computationally more efficient to perform the test in this manner) then the result is already present in register A 326. Otherwise, this value must be raised to the power 1/p, where p is the compression power. To raise the number represented logarithmically in register A 326 to a power 1/p, it is sufficient to multiply the value stored in register A 326 by 1/p. This is done using a standard shift-and-add technique. The result of the comparison at comparator 330 is provided to controller 334, which implements the above decision, and causes the multiplication to take place, if necessary.

If the multiplication is necessary, the steps taken for the multiplication depend upon the value of p. If p=½, then 1/p=2, and a multiplication by 2 is necessary. This is accomplished by copying the contents of register A 326 to register B 332, loading it onto bus 308 and into shifter 318, which is configured to shift left one bit position. The result is passed through adder 320 and LUT 324, first by providing a gain memory value of zero from memory 316 to adder 320 and by selecting the "0" input of multiplexer 322. The passed-through value is stored in register A 326. Thus, whether a multiplication is required or not, the result $f^{-1}(G_1u)$ winds up in register A 326.

For a more general integer-valued 1/p, the multiplication is a multistep process that involves repeated cycles of shifting and adding. The general technique for a shift-and-add multiplication is well-known, but it remains worth mentioning that the addition requires the availability of the appropriate two operands at the inputs of adder 320. This is accomplished by using register C 312 to store temporary values by copying the contents of register A 326 to register B 322, and from there to register C 312 via bus 308, so that an intermediate result can be added to a shifted version of itself.

The result of computing $f^{-1}(G_1u)$ is stored in temporary memory buffer 305 via register B 332 and bus 308. Next, $G_1u$ is retrieved from temporary memory 305, placed on bus 308, passed through shifter 318 unchanged, and added to $G_c$, which is retrieved from gain memory 316. (Note that $G_1$, $G_2$, and the constant 0 are static, and may, in some cases, be implemented in ROM or otherwise programmed into gain memory 316, where these values may remain without being changed. However, $G_c$ is a variable that is obtained from AGC subcircuit 336 and is derived from the output of the second filter.) The result is stored in register A 326 and represents $G_cG_1u$. This value is input to LUT 324 by setting multiplexer 322 to select register A 326. The other input to LUT 324 is the value of $f^{-1}(G_1u)$, which is provided by temporary buffer 305 through bus 308, shifter 318 (acting in pass-through mode) and adder 320 (by providing a value of 0 from gain memory 316 as the second input). The logarithmic result represents $G_cG_1u+f^{-1}(G_1u)$ and is stored in register A 326.

Next, this result is used as the input to function $f(u, u_0, p)$. This function is calculated in a manner similar to that of $f^{-1}$( ), except that 1/p is replaced by p. This replacement necessitates a raising to a fractional power, inasmuch as 1/p is typically greater than 1. This is easily accomplished by multiplying by an integer value q using the shift and add procedure described above, followed by a division by an integer value r that is a power of 2, which is done by a simple right shift. The values q and r are chosen such that q/r=p. The final multiplication by $G_2$ is accomplished by selecting the value representing the gain $G_2$ from gain memory 316 and adding it to the result of the calculation of the function f( ). The final result obtained is passed from register A 326 through register B 332 and into second filter data memory 304.

At this point, all of the processing necessary to implement the filter 14, gain blocks 20 and 22, as well as nonlinear sum block 28 of FIG. 1 have been accomplished for the current A/D input sample. To implement filter 32, it is only necessary to use the values in second filter data memory 304 as input to another FIR (or alternately, IIR) filter implemented in a manner similar to the digital filter described above, using the same components. This implementation will be apparent to one skilled in the art, after having understood the description provided herein.

To implement a multi-channel system, only one circuit such as shown in FIG. 12 is required, and after performing the operations required for one frequency range, the circuit performs the operations required for the next frequency range, and successive frequency ranges as required, depending upon the number of channels. All of this is accomplished before another sample is taken by log A/D 300 of input signal 301. To sum the results of each channel, the individual channel results are stored in temporary buffer 305 as they are formed. The accumulated result is formed in register A 326 by reading each in turn from the temporary buffer memory 305, adding it to the contents of register A 326 using LUT 324, and storing the accumulated result in register A 326. This result is then output via register B 332, bus 308, and inverse logarithmic D/A converter 306, to generate an output signal 337.

Figure 14:
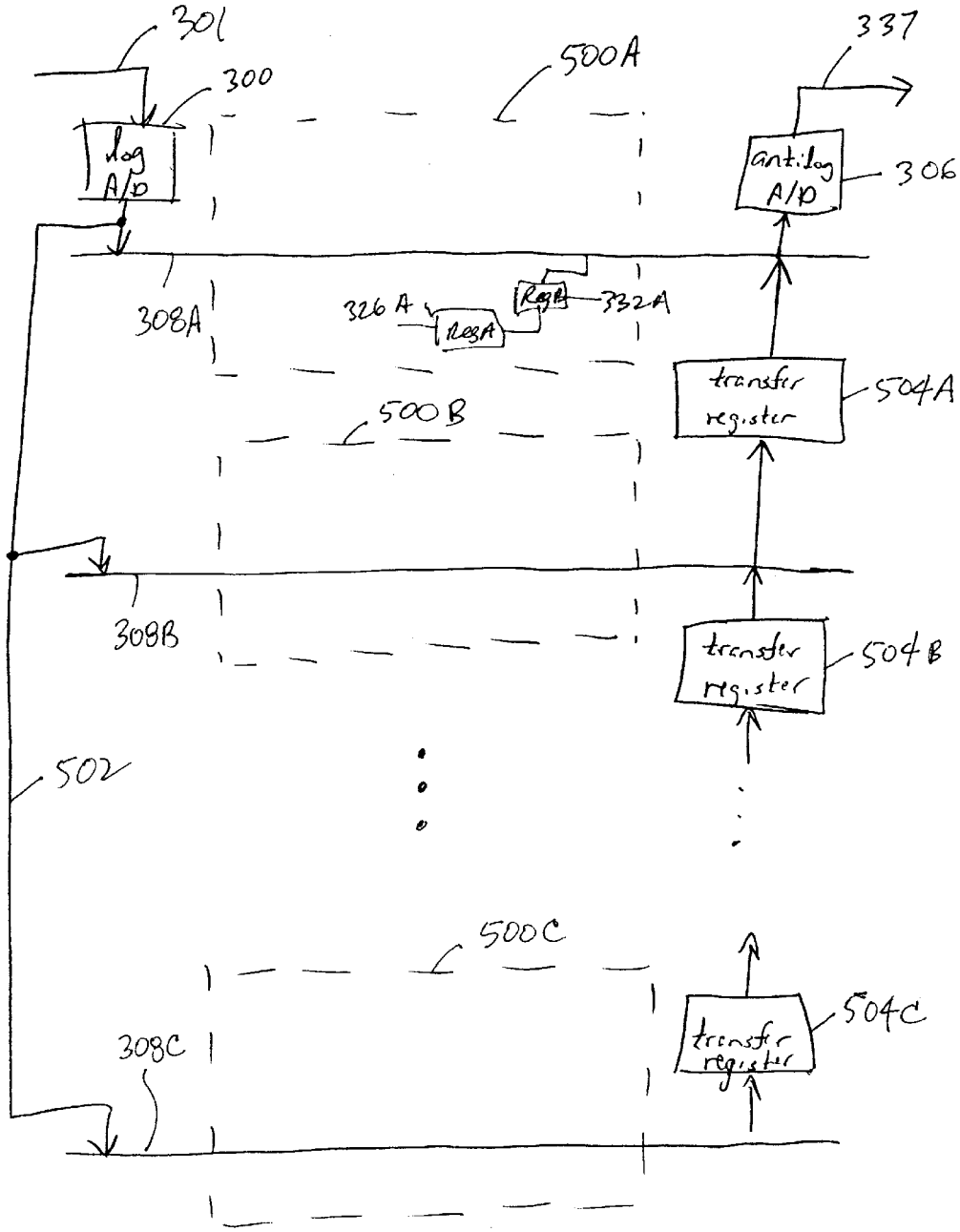
FIG. 14 is a graph showing the MBPNL hearing aid modulation responses to a steady-state vowel sound EW as a function of input level, for a middle octave channel 706 and an upper octave channel 708, for amplifiers in accordance with the invention.

In an alternate embodiment, replicated data paths may be used. In such an embodiment, the circuitry indicated by box 500 is repeated for each channel, as shown in FIG. 14. Blocks 500A, 500B, and 500C represent replications of the circuitry of box 500 in FIG. 12, for some selected number of channels (not necessarily three, as shown here for purposes of illustration). Busses 308A, 308B, and 308C represent the busses 308 in each of the blocks, and these busses are interconnected by line 502 from log A/D converter 300. Each channel operates in parallel on the same samples received from log A/D 300 in the manner described for the single channel. To sum the results of each channel, the individual channel results are all passed by the 500A channel datapath via transfer registers 504A, 504B, . . . , 504C.

To move each channel result into the transfer registers 504A, 504B, . . . , 504C, the value in register A 326 (referring to FIG. 12) in each of the channels 500A, 500B, . . . , 500C, is copied into register B 332 (see FIG. 12), loaded onto the busses 308A, 308B, . . . , 308C, and from there, into the attached transfer register 504A, 504B, . . . , 504C, respectively. Once stored in the transfer registers, the busses 308A, 308B, . . . , 308C are used to copy from each transfer register to the transfer register above, like a bucket brigade.

Starting with the channel 500A result stored in register A 326 of channel 500A, as each channel result is moved up one channel, the current value in transfer register 504A is added to channel 500A register A 326A (corresponding to register A 326 in FIG. 12) using the internal LUT (not shown in FIG. 14) of channel 500A, and the result is accumulated in register A 326A. Once the results from all the channels have been accumulated, the sum (currently in register A 326A of channel 500A) is output through the antilog D/A 306. At this point, the inventive system embodiment represented in FIG. 14 is ready to receive the next sample from log A/D 300, and the entire process repeats again.

It should be noted that a separate AGC subcircuit 336 is not a requirement for the embodiments described herein. A suitable implementation of AGC in the digital channel embodiments would take the absolute values of the results of the channel and pass this value into a low pass filter. For example, a suitable digital calculation to derive AGC values is:

$$x_{t+1} = \frac{x_t(n-1) + |x_{in}|}{n},$$

where:

$x_{t+1}$=the new AGC filter output, which may control the gain up or down;

$x_t$=the old AGC filter output;

n=a tuning parameter, which determines the time constant of the filter; and $x_n$=input of the AGC filter, which is the output of the channel.

It will be understood, in view of the description of the circuit of FIG. 12 contained herein and the generality of the operations that it can perform, that this AGC function, or other similar functions, can be performed by the registers, adders, look-up table, and memories of the circuit of FIG. 12 without the need for a separate subcircuit 336 dedicated to the AGC task.

It will be understood by those of ordinary skill in the art that, because logarithmic values are used in the digital circuitry of FIG. 12, it is necessary to represent plus and minus signs of signals separately, and that the adder and look-up table must be cognizant of these separate signs. However, once understood, this will be seen to be a minor implementation detail that can readily be handled with standard digital circuitry and computational techniques.

From these figures and this description, a circuit technician of ordinary skill in the art would be able to select appropriate components, such as operational amplifiers, resistors, transistors, and diodes, to physically construct either the analog or digital circuits of this invention at an appropriate level of miniaturization. Such component-level details are not considered as part of this invention and are left to a technician as a design choice.

It will be evident to those skilled in the art that, if miniaturization is not required (e.g., such for devices used for diagnostic purposes), an implementation using standard DSP (digital signal processor) components, may be appropriate, as such implementations may include the greater flexibility needed for diagnostic purposes, albeit in a larger package. In this case, referring to FIG. 12, a suitable A/D converter 602 receives signals from a microphone 600 and outputs the resulting digitized signal to a digital signal processor (DSP) 604. DSP 604 processes the digital signal and outputs a processed digital signal to D/A converter 606, which produces an analog signal that is fed to a speaker or earphone 608.

DSP 604 is programmed to perform the following operations, which are presented below in pseudocode (one of average skill in the art could perform the translation of the pseudocode to a flow chart if called upon to do so, but would more likely code a program equivalent to the pseudocode without doing so):

```
Loop
  input audio sample v
  for i=1 to number of channels
    w(i)=filter_i(v)
    x(i)=transducer (w(i), G_c(i)
    y(i)=filter_i(x (i))
    G_c(i)=AGC(y(i))
  end for
  z=sum over number of channels of y(i) output audio
    sample z
End loop.
```

The nonlinear portion of the calculation is performed in the calculation of x(i). It will, of course, be recognized that the code implementing these operations will be stored in a memory associated with DSP 604, and may be included as part of an integrated implementation of DSP 604.

Whether a digital or analog implementation is used, improved hearing correction is provided by hearing aids in accordance with this invention than with prior hearing aids.

For example, in FIG. 13, the spectral responses to the steady state vowel sound EH bet is shown. The dashed lines 700A, 702A, and 704A represent the spectrum of this sound at different input levels. The solid lines 700B, 702B, and 704B represent the output of an MBPNL system, such as the digital implementation discussed above, providing octave channel gains of 40 dB, 20 dB, and 0 dB, respectively, in accordance with the input signal level, as the gain levels change in response to the input signal level. It will be seen that the peaks of the input signal are retained even at high volume levels, and that intermodulation distortion produced by compression is low (lower, in fact, than with prior art hearing aids) at high levels.

FIG. 14 shows the MBPNL hearing aid modulation responses to a steady-state vowel sound EH as a function of input level, for a middle octave channel 706 and an upper octave channel 708. Note particularly that the modulation of the MBPNL hearing aid (as does that of the MFBPNL hearing aid, although not shown in FIG. 14) returns to normal at high levels; i.e., the hearing aid response again becomes desirably linear.

Figure 15:
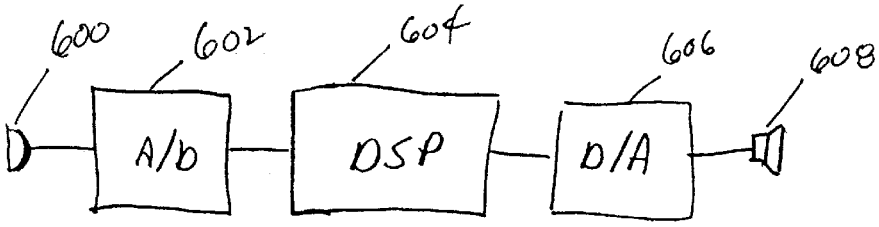
FIG. 15 is a graph showing the modulation transfer of the MBPNL and MFBPNL system in accordance with the invention.
Figure 16:
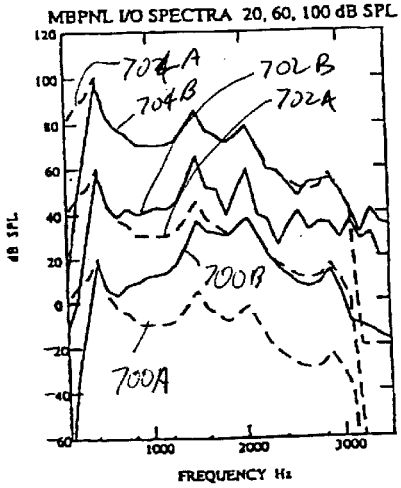
FIG. 16 is the modulation signal used to produce the curves of FIG. 15.
Figure 17:
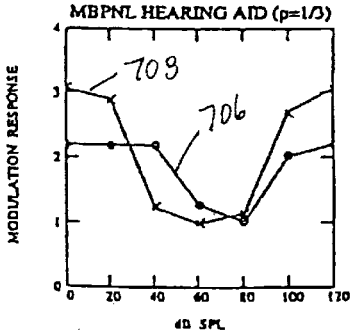
FIG. 17 is a graph showing the MBPNL hearing aid modulation responses to a steady-state vowel sound EH as a function of input level, for a middle octave channel 706 and an upper octave channel 708, for amplifiers in accordance with the invention.
Figure 18:
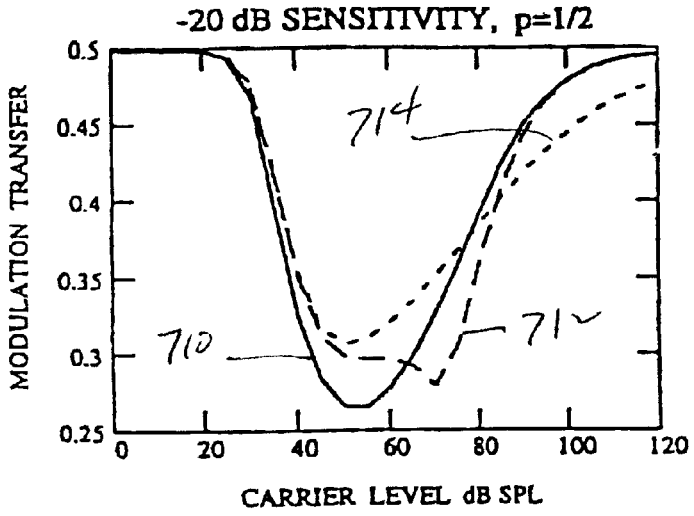
FIG. 18 is a graph showing the modulation transfer of the MBPNL and MFBPNL systems in accordance with the invention.
Figure 19:
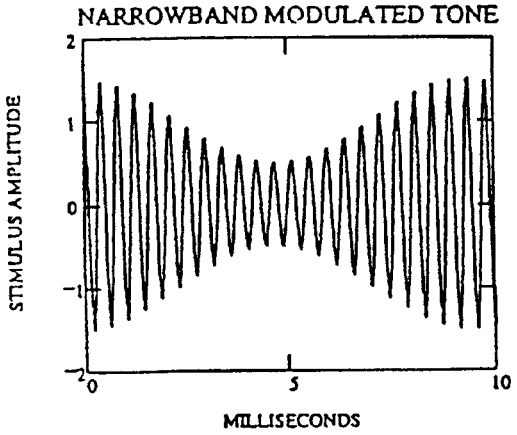
FIG. 19 is the modulation signal used to produce the curves of FIG. 18.

Finally, FIG. 15 shows the modulation transfer of the MBPNL and MFBPNL systems in accordance with the invention, and for comparison, shows a BPNL+Linear curve produced by removing the nonlinear transducer 28G in FIG. 3 and providing linear summation of the compressive and linear paths. (The modulation signal is shown in FIG. 16.) Note that both the MBPNL and MFBPNL responses 710 and 712, respectively, rapidly and desirably return to the ideal 0.5 modulation transfer at high carrier levels, unlike the BPNL+Linear response 714, which does not provide modulation recovery as advantageously as the inventive hearing aids, and therefore does not provide the lower spectral distortion of the inventive hearing aids.

It will thus be seen that the inventive hearing aids described herein provide intelligibility of signals heretofore unknown in the art. A maximum sensitivity to weak signals in the presence of sustained high levels is provided, while the ear is protected from uncomfortable, sudden intense sounds that occur too rapidly for effective conventional AGC control. Furthermore, a rapid switching between compressive and linear responses for high signal levels is obtained in accordance with the invention. Systematic audiological testing is made possible by providing a hearing aid in conjunction with a diagnostic device that are both derived from advanced audiological models. Such models reduce to a minimum the adjustments that may be required for hearing aid fitting, including the setting of gain for a single gain element in each frequency channel, while essentially eliminating the need for manual gain control. Thus, it will be seen that the various objects of the invention are achieved and other advantageous results are obtained.

The devices of the present invention may be used for diagnostic purposes, and for determining parameters of hearing aids to be fitted on individuals with impaired hearing. For example, the device of FIG. 12 may be used as follows: First, an audiogram of a patient with impaired hearing is obtained by standard means and compared with a standard audiogram. Next, the patient's maximum comfortable level for intense sounds is determined. The difference between the maximum comfortable level of the patient (in various frequency bands) and the patient's audiogram is the maximum impaired dynamic range. The difference between the maximum comfortable level of the patient for intense sounds and the normal audiogram is the normal dynamic range. The ratio of the normal dynamic range to that of the impaired dynamic range is the amount of compression that is required.

Once the required amount of compression is determined, a choice of GC (the amount of low level gain needed at low signal levels) and p (the compressive power) is made, based upon and in accordance with the models used in this invention, to produce the required compression. $G_c$ can be directly determined by the measured loss of sensitivity, while p can be selected from the values ½ and ⅓ subject to further testing for patient preference. The instrument of FIG. 12, which would be provided with controls or a keyboard to input the required frequency bands and the values of $G_c$ and p for each frequency band for simulation purposes, is then adjusted to produce the required amount of compression determined in the above steps. An audio test is then performed with signals being presented at the input of the device, which are amplified in accordance with the parameters that are provided, with the resulting audio output being provided to the patient. If the patient perceives the results as being satisfactory, a hearing aid may be provided to the patient in accordance with the gain and compression parameters determined. Otherwise, the values of $G_c$ and p can be adjusted until empirically satisfactory results are obtained. Biological correspondence of the hearing aid model with the cochlea model will ensure that a satisfactory compromise exists without overamplification of rapidly increasing sound levels. Once $G_c$ and p are determined, these can be used in the hearing aid amplifier design in accordance with either the analog or digital implementations described herein, or their equivalents. Preferably, one or both of these parameters may be externally adjustable for ease in fitting and for accommodating future hearing impairment changes, if necessary. The nature of the adjustments for the inventive hearing aid are particularly suited for compensating such changes, because of their basis in the cochlear models.

It will be noted that the inventive devices described herein may be advantageously employed as a research tool to explore various forms of patient hearing loss and appropriate corrective parameters.

Inasmuch as various changes and modifications to the embodiments described above may be made without departing from the scope of the invention, it is intended that the description and drawings be considered as illustrative rather than limiting. It will also be apparent that one may realize certain of the objects of the invention without realizing all of them in various less preferred embodiments that fit within the scope and spirit of the invention, but which may not necessarily be presented as example embodiments herein. Therefore, the scope of the invention should be determined by reference to the claims appended below in view of the disclosure, including any legal equivalents thereto.

What is claimed is:

1. In a hearing amplification device, the improvement comprising the hearing amplification device having at least one variable gain channel configured to provide relatively higher gain at low levels, substantially nonlinear instantaneous gain compression at intermediate levels converging to linear gain at high signal levels, and slow AGC control of the compressive gain.

2. The device of claim 1 having a plurality of variable gain channels each of which is responsive to a different audio frequency range.

3. The device of claim 2 wherein the plurality of variable gain channels are configured to have merging gains at higher input levels and diverging gains at lower input levels.

4. The device of claim 3 further comprising a linear transmission path of constant gain, a compressive transmission path of higher gain than the linear transmission path, and a nonlinear adder combining the outputs of the linear and the compressive transmission paths.

5. The device of claim 4, configured to provide a gain approaching unity for instantaneous high signal levels, and further comprising automatic gain control that slowly reduces low-level sensitivity in the presence of sustained high level signals.

6. The device of claim 5, wherein the automatic gain control is configured to reduce compressive gain components of the hearing amplification device, such that the high signal level at which unity gain is achieved is modified when the automatic gain control is active, and amplification of weak signals is also reduced.

7. The device of claim 5, configured to provide an MFBPNL gain characteristic.

8. The device of claim 7 wherein said device is adapted to fit in a human ear.

9. The device of claim 5, configured to provide an MBPNL gain characteristic.

10. The device of claim 9 wherein the variable gain channels substantially comprise digital components that process digital representations of audio signals.

11. The device of claim 10, wherein audio processing is performed by a digital signal processor under software control.

12. The device of claim 9 wherein said device is adapted to fit in a human ear.

13. A method of amplifying an audio signal for hearing aid fitting, comprising the steps of:

providing a variable gain channel configured to provide relatively higher gain at low levels and relatively low gain at higher levels;

providing substantially nonlinear instantaneous gain compression at intermediate levels converging to linear gain at high signal levels; and controlling the relatively higher gain at low levels via slow AGC control.

14. The method of claim 13 and further comprising providing a plurality of variable gain channels each of which is responsive to a different audio frequency range.

15. A method of correcting impaired hearing comprising:

amplifying relatively low signal levels a relatively greater amount;

compressively amplifying intermediate levels with substantially nonlinear instantaneous compression, the compression converging to linear gain at higher signal levels; and slowly adjusting the compressive gain under AGC control.

16. The method of claim 15 wherein the steps are performed for each of a plurality of different audio frequency ranges.

17. In a hearing amplification device, the improvement comprising the hearing amplification device having at least one variable gain channel comprising a linear transmission path of constant gain, a compressive transmission path of higher gain than the linear transmission path, and a nonlinear adder combining the outputs of the linear and the compressive transmission paths, wherein the variable gain channel is configured to provide relatively higher gain at low levels, rapid gain compression at intermediate levels converging to linear gain at high signal levels, and slow AGC control of the compressive gain, and wherein an instantaneous compressive transducer in the nonlinear adder comprises an analog multiplier in a feedback configuration.

18. The device of claim 17 wherein the nonlinear adder comprises analog components that process analog audio signals.

19. The device of claim 18 wherein an instantaneous expansive transducer in the nonlinear adder comprises an analog multiplier in a feedforward configuration.

20. The device of claim 19 and further comprising a single amplifier within the nonlinear adder to control the difference in gain between weak and strong input signals that provides a merging family of gain functions for moderate and strong input signals.

21. The device of claim 20 and further comprising slow AGC attenuation of the input signal to the compressive path of the nonlinear adder, thereby reducing the maximum gain of the compressive transmission path for weak signals in the presence of sustained strong signals without changing the gain of the amplifier within the feedback loop.

22. The device of claim 21 and further comprising an amplifier with slow AGC providing the input signal to the compressive path of the nonlinear adder with no adjustable elements, and pre- and post-amplifiers with fixed gains for providing a merging family of gain functions for moderate and strong input signals.

23. The device of claim 22 wherein the slow AGC control of the compressive gain provided by the variable gain channel is feedback control.

* * * * *